US012702155B2

(12) United States Patent
Holford et al.

(10) Patent No.: US 12,702,155 B2
(45) Date of Patent: Aug. 11, 2026

(54) CONSUMABLE FOR AN AEROSOL PROVISION SYSTEM

(71) Applicant: Nicoventures Trading Limited, London (GB)

(72) Inventors: Steven Holford, London (GB); Thomas Leah, London (GB)

(73) Assignee: Nicoventures Trading Limited, London (GB)

( * ) Notice: Subject to any disclaimer, the term of this patent is extended or adjusted under 35 U.S.C. 154(b) by 508 days.

(21) Appl. No.: 18/040,095

(22) PCT Filed: Jul. 30, 2021

(86) PCT No.: PCT/GB2021/051973
§ 371 (c)(1),
(2) Date: Jan. 31, 2023

(87) PCT Pub. No.: WO2022/023763
PCT Pub. Date: Feb. 3, 2022

(65) Prior Publication Data

US 2023/0301345 A1 Sep. 28, 2023

(30) Foreign Application Priority Data

Jul. 31, 2020 (GB) ..... 2011953

(51) Int. Cl.
*A24D 1/20* (2020.01)
*A24B 15/12* (2006.01)
*A24D 3/06* (2006.01)

(52) U.S. Cl.
CPC ..... *A24D 1/20* (2020.01); *A24B 15/12* (2013.01); *A24D 3/067* (2013.01)

(58) Field of Classification Search
None
See application file for complete search history.

(56) References Cited

U.S. PATENT DOCUMENTS

2018/0116274 A1 5/2018 Zuchuat et al.
2018/0279666 A1 10/2018 Aoun et al.
2020/0221767 A1 7/2020 Emmett et al.
2020/0229506 A1* 7/2020 Besso ..... A24D 1/008
(Continued)

FOREIGN PATENT DOCUMENTS

EP 0545186 A2 6/1993
EP 3735842 A1 11/2020
JP 2019526242 9/2019
(Continued)

OTHER PUBLICATIONS

JP Office Action in Japanese Application No. 2023-501592, dated Jan. 21, 2025, 14 pages.
(Continued)

*Primary Examiner* — Dennis R Cordray
(74) *Attorney, Agent, or Firm* — Merchant & Gould P.C.

(57) ABSTRACT

A consumable for use in a non-combustible aerosol provision system including an aerosol-generating segment having at least one aerosol-generating material and a mouthpiece segment including a section of an amorphous solid material. It also relates to a non-combustible aerosol provision system, a method for producing a consumable, and use of a section of an amorphous solid material.

23 Claims, 3 Drawing Sheets

(56) References Cited

U.S. PATENT DOCUMENTS

| | | | |
|---|---|---|---|
| 2021/0051993 | A1 | 2/2021 | Kim et al. |
| 2021/0298358 | A1 | 9/2021 | Ghanouni |

FOREIGN PATENT DOCUMENTS

| | | | |
|---|---|---|---|
| KR | 10-2019-0083314 | | 7/2019 |
| WO | 2012117881 | A1 | 9/2012 |
| WO | 2012120628 | A1 | 9/2012 |
| WO | 2018/019578 | A1 | 2/2018 |
| WO | 2019/077083 | A1 | 4/2019 |
| WO | 2020012330 | | 1/2020 |
| WO | 2020/025722 | A1 | 2/2020 |
| WO | 2020/025730 | A1 | 2/2020 |
| WO | 2020025723 | | 2/2020 |
| WO | 2020028468 | | 2/2020 |
| WO | 2020/074494 | A1 | 4/2020 |
| WO | 2020/089078 | A1 | 5/2020 |
| WO | 2020089055 | A1 | 5/2020 |
| WO | 2020100884 | A1 | 5/2020 |
| WO | 2021/118186 | A2 | 6/2021 |

OTHER PUBLICATIONS

International Search Report and Written Opinion received for PCT Patent Application No. PCT/GB2021/051973, mailed on Nov. 19, 2021, 17 pages.

Korean Office Action for Korean Application No. 10-2023-7006806, dated Dec. 30, 2025, 14 pages (7 pages English Translation, 7 pages Official Copy).

International Search Report and Written Opinion received for PCT Patent Application No. PCT/GB2021/051976, mailed on Nov. 19, 2021, 17 pages.

* cited by examiner

CONSUMABLE FOR AN AEROSOL PROVISION SYSTEM

PRIORITY CLAIM

The present application is a National Phase entry of PCT Application No. PCT/GB2021/051973, filed Jul. 30, 2021, which claims priority from GB Application No. 2011953.3, filed Jul. 31, 2020, each of which are hereby fully incorporated herein by reference.

FIELD

The present invention relates to a consumable for use in an aerosol provision system, a non-combustible aerosol provision system, a method for producing a consumable, and uses of a section of an amorphous solid material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, smokeable material.

SUMMARY

According to a first aspect of the invention, there is provided a consumable for use in a non-combustible aerosol provision system comprising an aerosol-generating segment comprising at least one aerosol-generating material and a mouthpiece segment comprising a section of an amorphous solid material.

In some embodiments, the consumable has the form of a rod having a first end and a second end, the rod comprising a plurality of portions, one of which comprises the section of an amorphous solid material and at least one portion comprising at least one aerosol-generating material.

In some embodiments, the section of an amorphous solid material comprises a gathered sheet of amorphous solid material.

In some embodiments, the section of an amorphous solid material comprises elongate strips of amorphous solid material. Optionally, the elongate strips are substantially aligned with the longitudinal axis of the consumable.

In some embodiments, the amorphous solid material has a thickness of between about 0.5 mm and about 2 mm, or between about 1 mm and about 2 mm.

In some embodiments, the amorphous solid material is provided on a supporting material. Optionally, the supporting material is paper or foil.

In some embodiments, the supporting material comprises a susceptor.

In some embodiments, the amorphous solid material is crimped.

In some embodiments, the amorphous solid material comprises a gelling agent. Optionally, the gelling agent is one or more selected from the group consisting of carboxymethyl cellulose, alginate, pectin, gelatin, polysaccharide, guar gum and carageenan.

In some embodiments, the amorphous solid material comprises an aerosol-former material. Optionally, the aerosol-former material is one or more selected from the group consisting of: erythritol, propylene glycol, glycerol, vegetable glycerine, triacetin, sorbitol and xylitol.

In some embodiments, the amorphous solid material comprises a flavorant, and optionally, wherein the flavorant is menthol.

In some embodiments, the at least one aerosol-generating material in the portion comprises tobacco material.

In some embodiments, the tobacco material comprises a reconstituted tobacco material, and optionally a paper reconstituted tobacco material.

In some embodiments, the mouthpiece segment further comprises a body of fibrous material.

In some embodiments, the mouthpiece segment comprises a hollow tubular element. Optionally, the hollow tubular element is a paper tube or is formed from filamentary tow.

In some embodiments, the hollow tubular element is positioned between the section of amorphous solid material and the portion comprising an aerosol-generating material.

In some embodiments, the section of amorphous solid material and the portion comprising an aerosol-generating material are directly adjacent one another.

In some embodiments, in consumable comprises a hollow tubular element at the mouth end.

In some embodiments, the mouthpiece comprising one or more flavor modifying elements. Optionally, the flavor modifying element is a capsule.

According to a second aspect of the invention, there is provided a non-combustible aerosol provision system comprising a non-combustible aerosol provision device and a consumable according to the first aspect.

According to a third aspect of the invention, there is provided a method for producing consumable according to the first aspect, comprising gathering a sheet of amorphous solid material to form a section of amorphous solid material.

According to a fourth aspect of the invention, there is provided a method for producing consumable, comprising cutting a sheet of amorphous solid material to form a plurality of strips of amorphous solid material from which a section of amorphous solid material is formed.

In some embodiments, the strips have a cut length of at least about 5 mm.

According to a fifth aspect of the invention, there is provided use of a section of amorphous solid material in a consumable to reduce the temperature of the aerosol upon use of the consumable in a non-combustible aerosol provision system.

BRIEF DESCRIPTION OF THE DRAWINGS

Embodiments of the invention will now be described, by way of example only, with reference to accompanying drawings, in which.

DETAILED DESCRIPTION

Figure 1:
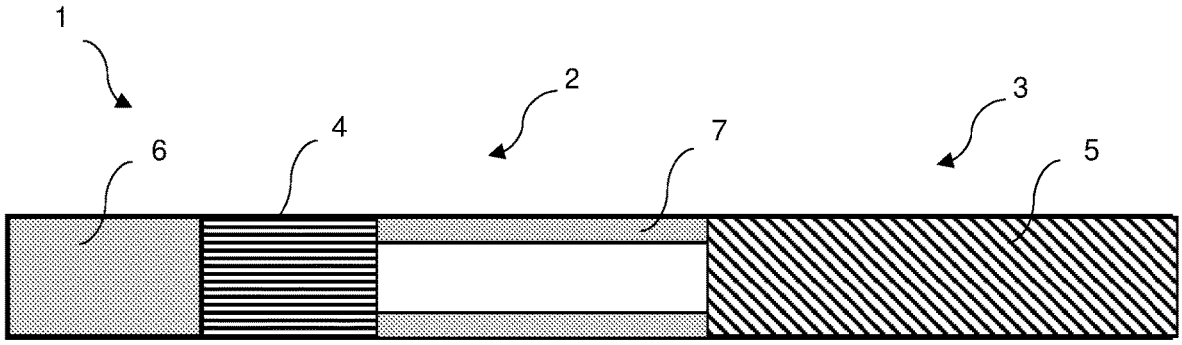
FIG. 1 is a side-on cross sectional view of a first embodiment of a consumable for use with a non-combustible aerosol provision device.

The present invention relates to consumable comprising an aerosol-generating segment comprising at least one aerosol-generating material and a mouthpiece segment comprising a section of an amorphous solid material. The consumable is for use in a non-combustible aerosol provision system.

Aerosol-generating material is a material that is capable of generating aerosol, for example when heated, irradiated or energized in any other way. The aerosol-generating material may comprise one or more active substances and/or flavors, one or more aerosol-former materials, and optionally one or more other functional material.

The amorphous solid material is an aerosol-generating material, as it is capable of generating aerosol when heated, irradiated or energized in any other way. However, positioned within the mouthpiece segment of the consumable, the amorphous solid material may not be heated directly by the aerosol delivery device. The amorphous material will be heated by exposure to a heated aerosol generated by the heating of the aerosol-generating segment of the consumable.

As the heated aerosol generated by heating the aerosol-generating segment of the consumable passes through the section of amorphous material, the amorphous material acts as a heat sink, reducing the temperature of the aerosol. The amorphous material may be heated by the heated aerosol generated from the aerosol-generating segment of the consumable and this may result in the release volatile components such as aerosol-former and flavors from the amorphous solid material.

Importantly, the amorphous solid material is not melted by exposure to the heated aerosol and does not change phase. Thus, the consumable including the section of amorphous solid material will substantially maintain its structural integrity upon use.

In some embodiments, the temperature of the heated aerosol prior to contact with the amorphous solid material is from about 250° C. to about 60° C., depending on the position of the section of amorphous solid material in the consumable.

The aerosol is cooled as it travels through the section of amorphous solid material. In some embodiments, the section of amorphous solid material provides an additional reduction in the temperature of the aerosol of approximately 10° C., compared to the effect of a section of the same size comprising a conventional cellulose acetate tow.

The total aerosol temperature drop as the aerosol travels from the aerosol-generating material from whence it is generated to the mouth end of the consumable will depend upon a number of factors, including, for example, the nature of the consumable portions it travels through and their position in the consumable, as well as the overall format (i.e. the length and diameter) of the consumable.

Nevertheless, it is clear that the section of amorphous solid material has heat sink properties which can be used to control the temperature of the aerosol when it reaches the user.

In some embodiments, the temperature of the aerosol as it exits the section of amorphous solid material is from about 180° C. to about 40° C., depending on the position of the section of amorphous solid material in the consumable.

In some embodiments, the section of amorphous solid material has a length of from about 7 mm to about 30 mm, optionally from about 10 mm to about 20 mm.

Upon use of the consumable, the amorphous solid material acts as a heat sink, reducing the temperature of the aerosol generated by heating the aerosol-generating material of the consumable. Without wishing to the bound by any one particular theory, it is hypothesised that the dense nature of the amorphous solid material and its ability to absorb water/steam contributes to the absorption of heat. In some embodiments, the section of amorphous solid material may be optimised to absorb steam generated in the first few puffs when hot puff occurs.

When the heated aerosol contacts the section of amorphous solid material, at least some of (and potentially most of) the steam present in the aerosol will condense on the solid amorphous solid material rather than remaining in the vapour phase. The steam is therefore prevented from being transferred to the consumer's mouth where it would condense on the lips/mouth cavity and cause the burning sensation.

In addition to reducing the temperature of the aerosol, the amorphous solid material may also generate aerosol and/or vapour itself as it is heated by the aerosol from the aerosol-generating material. In some embodiments, this aerosol generated by the amorphous solid material includes components that have desired properties, including body and mouthfeel, as well as optionally one or more active substance and/or flavors.

The consumables may have a number of advantages in addition to the improved temperature of the aerosol delivered to the user. Other heat sinks tend to remove volatiles from the aerosol as it passes through. This can lead to aerosols with inferior taste and delivered actives. In contrast, fewer components are removed from the aerosol as it passes through the section of amorphous solid material. Indeed, in some embodiments, the amorphous solid material may release desirable components into the aerosol, as discussed briefly above.

In addition, the consumables enjoy good closed pressure drop.

Amorphous Solid Material

The amorphous solid material may alternatively be referred to as a "monolithic solid" (i.e. non-fibrous). In some embodiments, the amorphous solid material may be a dried gel. The amorphous solid material is a solid material that may retain some fluid, such as liquid, within it.

The amorphous solid material comprises one or more aerosol-former materials. Optionally, it may further comprise one or more active substances and/or flavors, and/or optionally one or more other functional materials.

The one or more other functional materials may comprise one or more of pH regulators, colouring agents, preservatives, binders, fillers, stabilizers, and/or antioxidants.

Suitably, the amorphous solid material may comprise from about 1 wt %, 5 wt %, 10 wt %, 15 wt %, 20 wt % or 25 wt % to about 60 wt %, 50 wt %, 45 wt %, 40 wt % or 35 wt % of a gelling agent (all calculated on a dry weight basis). For example, the amorphous solid material may comprise 1-50 wt %, 5-45 wt %, 10-40 wt % or 20-35 wt % of a gelling agent. In some embodiments, the gelling agent comprises a hydrocolloid.

In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid material. In some cases, the amorphous solid material may comprise a calcium-crosslinked alginate and/or a calcium-crosslinked pectin.

In some embodiments, the gelling agent comprises alginate, and the alginate is present in the amorphous solid material in an amount of from 10-30 wt % of the amorphous solid material (calculated on a dry weight basis). In some embodiments, alginate is the only gelling agent present in the amorphous solid material. In other embodiments, the gelling agent comprises alginate and at least one further gelling agent, such as pectin.

In some embodiments the amorphous solid material may include gelling agent comprising carrageenan.

Suitably, the amorphous solid material may comprise from about 0.1 wt %, 0.5 wt %, 1 wt %, 3 wt %, 5 wt %, 7 wt % or 10 wt to about 50 wt %, 45 wt %, 40 wt %, 35 wt %, 30 wt % or 25 wt % of an aerosol-former material (all calculated on a dry weight basis). For example, the amorphous solid material may comprise 0.5-40 wt %, 3-35 wt % or 10-25 wt % of an aerosol-former material.

As used herein, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some cases, the aerosol-former material comprises one or more compound selected from erythritol, propylene glycol, glycerol, vegetable glycerine (VG), triacetin, sorbitol and xylitol. In some cases, the aerosol-former material comprises, consists essentially of or consists of glycerol.

The aerosol-former material may act as a plasticiser when included in the amorphous solid material. Therefore, it may be desirable to include greater amounts of aerosol-former material in the amorphous solid material where the gelling agent used would otherwise result in a brittle material. Thus, for example, at least 7 wt % or more of aerosol-former material, such as glycerol, may be included where the gelling agent is an alginate. This amount of aerosol-former material provides the alginate-based amorphous solid material with the required level of plasticity to allow the forming of a consumable section without breakage.

In some embodiments, the amorphous solid material comprises a flavor. Suitably, depending upon the nature of the flavor, the amorphous solid material may comprise up to about 80 wt %, 70 wt %, 60 wt %, 55 wt %, 50 wt % or 45 wt % of a flavor. In some cases, the amorphous solid material may comprise at least about 0.1 wt %, 1 wt %, 10 wt %, 20 wt %, 30 wt %, 35 wt % or 40 wt % of a flavor (all calculated on a dry weight basis).

For example, the amorphous solid material may comprise 1-80 wt %, 10-80 wt %, 20-70 wt %, 30-60 wt %, 35-55 wt % or 30-45 wt % of a flavor. In some cases, the flavor comprises, consists essentially of or consists of menthol.

Flavor provided in the amorphous solid material may be more stably retained within the amorphous solid material compared to flavor added directly to the tobacco material, resulting in a more consistent flavor profile between consumables as disclosed herein.

In some embodiments, the amorphous solid material does not include a flavor.

In some cases, the amorphous solid material may additionally comprise an emulsifying agent, which emulsifies the flavor during manufacture. In embodiments where the flavor is solid at room temperature, the flavor may be heated to molten form and mixed with the emulsifying agent. The amorphous solid material may comprise from about 0.1 wt %, from about 0.2 wt % or from about 0.5 wt % to about 15 wt % of an emulsifying agent (calculated on a dry weight basis), suitably about 10 wt %. Suitable emulsifying agents include sorbitans (such as SPANs), polysorbates (such as TWEENs) and acacia gum.

In some embodiments, the amorphous solid material is a hydrogel and comprises less than about 20 wt % of water calculated on a wet weight basis. In some cases, the hydrogel may comprise less than about 15 wt %, 12 wt % or 10 wt % of water calculated on a wet weight basis. In some cases, the hydrogel may comprise at least about 1 wt %, 2 wt % or at least about 5 wt % of water (WWB).

In some embodiments, and where local regulations permit, the amorphous solid material additionally comprises an active substance. For example, in some cases, the amorphous solid material additionally comprises a tobacco material and/or nicotine. In some cases, the amorphous solid material may comprise 5-60 wt % (calculated on a dry weight basis) of a tobacco material and/or nicotine. In some cases, the amorphous solid material may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of an active substance. In some cases, the amorphous solid material may comprise from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of a tobacco material. For example, the amorphous solid material may comprise 10-50 wt %, 15-40 wt % or 20-35 wt % of a tobacco material. In some cases, the amorphous solid material may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid material may comprise 1-20 wt %, 2-18 wt % or 3-12 wt % of nicotine.

In some cases, and where local regulations permit, the amorphous solid material comprises an active substance such as tobacco extract. In some cases, the amorphous solid material may comprise 5-60 wt % (calculated on a dry weight basis) of tobacco extract. In some cases, the amorphous solid material may comprise from about 5 wt %, 10 wt %, 15 wt %, 20 wt % or 25 wt % to about 60 wt %, 50 wt %, 45 wt %, 40 wt %, 35 wt %, or 30 wt % (calculated on a dry weight basis) tobacco extract. For example, the amorphous solid material may comprise 10-50 wt %, 15-40 wt % or 20-35 wt % of tobacco extract. The tobacco extract may contain nicotine at a concentration such that the amorphous solid material comprises 1 wt % 1.5 wt %, 2 wt % or 2.5 wt % to about 6 wt %, 5 wt %, 4.5 wt % or 4 wt % (calculated on a dry weight basis) of nicotine.

In some cases, there may be no nicotine in the amorphous solid material other than that which results from the tobacco extract.

In some embodiments the amorphous solid material comprises no tobacco material but does comprise nicotine. In some such cases, the amorphous solid material may comprise from about 1 wt %, 2 wt %, 3 wt % or 4 wt % to about 20 wt %, 18 wt %, 15 wt % or 12 wt % (calculated on a dry weight basis) of nicotine. For example, the amorphous solid material may comprise 1-20 wt %, 2-18 wt % or 3-12 wt % of nicotine.

In some cases, the total content of active substance and/or flavor may be at least about 0.1 wt %, 1 wt %, 5 wt %, 10 wt %, 20 wt %, 25 wt % or 30 wt %. In some cases, the total content of active substance and/or flavor may be less than about 90 wt %, 80 wt %, 70 wt %, 60 wt %, 50 wt % or 40 wt % (all calculated on a dry weight basis).

In some cases, the total content of tobacco material, nicotine and flavor may be at least about 0.1 wt %, 1 wt %, 5 wt %, 10 wt %, 20 wt %, 25 wt % or 30 wt %. In some cases, the total content of active substance and/or flavor may be less than about 90 wt %, 80 wt %, 70 wt %, 60 wt %, 50 wt % or 40 wt % (all calculated on a dry weight basis).

The amorphous solid material may be made from a gel, and this gel may additionally comprise a solvent, included at 0.1-50 wt %. However, the inventors have established that the inclusion of a solvent in which the flavor is soluble may reduce the gel stability and the flavor may crystallise out of the gel. As such, in some cases, the gel does not include a solvent in which the flavor is soluble.

In some embodiments, the amorphous solid material comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid material comprises less than 20 wt %, suitably less than 10 wt % or less than 5 wt % of a filler. In some cases, the amorphous solid material comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives, including microcrystalline cellulose. In particular cases, the amorphous solid material comprises no calcium carbonate such as chalk.

In particular embodiments which include filler, the filler is fibrous. For example, the filler may be a fibrous organic filler material such as wood pulp, hemp fiber, cellulose or cellulose derivatives. Without wishing to be bound by theory, it is believed that including fibrous filler in an amorphous solid material may increase the tensile strength of the material.

In some embodiments, the amorphous solid material does not comprise tobacco fibers.

In some embodiments, the amorphous solid material is provided in sheet form.

In some embodiments, such as where the amorphous solid material does not comprise a filler, the amorphous solid material may have a tensile strength of from 200 N/m to 400 N/m, or 200 N/m to 300 N/m, or about 250 N/m. Such tensile strengths may be particularly suitable for embodiments wherein the amorphous solid material is formed as a sheet and then shredded and incorporated into an aerosol-generating article.

In some embodiments, such as where the amorphous solid material is used in sheet form, a filler is included to increase the tensile strength. In some embodiments, the amorphous solid material may have a tensile strength of at least about 2000 N/m and/or up to about 5000 N/m. In some embodiments, the tensile strength may be from about 3000 to about 4000 N/m. Such tensile strengths may be particularly suitable for embodiments wherein the amorphous solid material is included in the consumable as a rolled sheet.

In some cases, the amorphous solid material may consist essentially of, or consist of a gelling agent, water, an aerosol-former material, a flavor, and optionally an active substance.

In some cases, the amorphous solid material may consist essentially of, or consist of a gelling agent, water, an aerosol-former material, a flavor, and optionally a tobacco material and/or a nicotine source.

In some examples, the amorphous solid material comprises: 1-60 wt % of a gelling agent; 0.1-50 wt % of an aerosol-former agent; 0-20 wt % of filler; and 0.1-80 wt % of a flavor; wherein these weights are calculated on a dry weight basis.

Plug of Amorphous Solid Material

As discussed above, the consumable includes a section or plug of an amorphous solid material. In some embodiments, the section or plug of an amorphous solid material is formed from a sheet of amorphous solid material. In some embodiments, the section or plug consists of, or consists essentially of, a sheet of amorphous solid material.

In some embodiments, the section or plug of amorphous solid material comprises, for example, from about 25 wt %, 30 wt %, 35 wt %, 40 wt %, 45 wt %, 50 wt %, 60 wt % or 70 wt % of amorphous solid material, to about 70 wt %, 75 wt %, 80 wt %, 85 wt %, 90 wt %, 95 wt % or 100 wt % of amorphous solid material. In some embodiments, the section or plug consists essentially of amorphous solid material. In some embodiments, the section or plug consists of amorphous solid material. In embodiments where the amorphous solid material is in sheet form, or in shredded sheet form, the section or plug comprises from about 25% to about 70% by volume of amorphous solid material. In embodiments where the amorphous solid material is in the form of beads, the section or plug comprises at least about 50% by volume of amorphous solid material and optionally from about 50% to about 80% by volume.

In some embodiments, the sheet of amorphous solid material is incorporated into the section or plug as a gathered or bunched sheet, as a crimped sheet. The sheet may be in gathered, wound or coiled form. In other embodiments, the sheet may be shredded and then gathered into a section or plug, optionally circumscribed with a wrapper or another sheet material to hold the material together. In some embodiments, the section or plug further comprises an inert sheet or other inert filler, in addition to the amorphous solid material, to give a desired fill volume. This inclusion of such as filler may also reduce the overall weight of the section and of the consumable.

In some embodiments, the section or plug of amorphous solid material comprises, for example, from about 50%, 60% or 70% by volume of amorphous solid material, to about 80%, 85% or 90% by volume of amorphous solid material. This ensures that the pressure drop across the whole consumable is not influenced by the section of amorphous solid material.

In some embodiments, the amorphous solid material in sheet form may have an area density from about 30 $g/m^2$ to about 150 $g/m^2$. In some cases, the sheet may have a mass per unit area of about 55 g/m$^2$ to about 135 g/m$^2$, or about 80 to about 120 g/m$^2$, or from about 70 to about 110 g/m$^2$, or particularly from about 90 to about 110 g/m$^2$, or suitably about 100 g/m$^2$. Such area densities may be particularly suitable where the amorphous solid material is included in an aerosol-generating article as a shredded sheet.

The section or plug of amorphous solid material may have any suitable area density, such as from 30 g/m$^2$ to 120 g/m$^2$. In some cases, the sheet may have a mass per unit area of 80-120 g/m$^2$, or from about 70 to 110 g/m$^2$, or particularly from about 90 to 110 g/m$^2$, or suitably about 100 g/m$^2$.

In some cases, the sheet of amorphous solid material may include a carrier layer. The carrier layer may be substantially or wholly impermeable to gas and/or aerosol. This prevents aerosol or gas passage through the carrier, thereby controlling the flow and ensuring good delivery to the user.

The carrier may be any suitable material which can be used to support an amorphous solid material. In some cases, the carrier may be formed from materials selected from metal foil, paper, carbon paper, greaseproof paper, ceramic, carbon allotropes such as graphite and graphene, plastic, cardboard, wood or combinations thereof. In some cases, the carrier may comprise or consist of a tobacco material, such as a sheet of reconstituted tobacco. In some cases, the carrier may be formed from materials selected from metal foil, paper, cardboard, wood or combinations thereof. In some cases, the carrier itself may be a laminate structure comprising layers of materials selected from the preceding lists. In some cases, the carrier may also function as a flavor carrier. For example, the carrier may be impregnated with a flavorant or with tobacco extract.

In some embodiments, the carrier or support comprises a susceptor. In some embodiments, the susceptor is embedded within the carrier. In some alternative embodiments, the susceptor is on one or either side of the carrier.

In some cases, the surface of the carrier that abuts the amorphous solid material may be porous. For example, in some cases, the carrier comprises paper. The inventors have found that a porous carrier such as paper is particularly suitable for the present invention; the porous (paper) layer abuts the amorphous solid material layer and forms a strong bond. The amorphous solid material is formed by drying a gel and, without being limited by theory, it is thought that the slurry from which the gel is formed partially impregnates the porous carrier (e.g. paper) so that when the gel sets and forms cross-links, the carrier is partially bound into the gel. This provides a strong binding between the gel and the carrier (and between the dried gel and the carrier).

Additionally, surface roughness may contribute to the strength of bond between the amorphous solid material and the carrier. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

In some embodiments, a paper and greaseproof paper laminate may be used. The paper layer abuts the amorphous solid material and the tacky amorphous solid material does not stick readily to the greaseproof paper carrier backing.

In some cases, the carrier may have a thickness of between about 0.01 mm and about 2 mm, suitably from about 0.015 mm, 0.02 mm, 0.05 mm or 0.1 mm to about 1.5 mm, 1 mm, or 0.5 mm.

In some cases, the amorphous solid material layer may have a thickness of about 0.015 mm to about 1.5 mm, suitably about 0.05 mm to about 1.5 mm or 0.05 mm to about 1 mm. Suitably, the thickness may be in the range of about 0.1 mm or 0.15 mm to about 1 mm, 0.5 mm or 0.3 mm. The amorphous solid material may comprise more than one layer, and the thickness described herein refers to the aggregate thickness of those layers.

The thickness of the amorphous solid material may be measured using a calliper or a microscope such as a scanning electron microscope (SEM), as known to those skilled in the art, or any other suitable technique known to those skilled in the art.

The inventors have established that if the amorphous solid material is too thin, it can be difficult to manufacture and handle; a very thin material can be harder to cast and may be fragile, compromising aerosol formation in use.

In some cases, an individual strip or piece of the amorphous solid material on a carrier layer has a minimum thickness over its area of about 0.015 mm. In some cases, an individual strip or piece of the amorphous solid material has a minimum thickness over its area of about 0.05 mm or about 0.1 mm. In some cases, an individual strip or piece of the amorphous solid material has a maximum thickness over its area of about 1.0 mm. In some cases, an individual strip or piece of the amorphous solid material has a maximum thickness over its area of about 0.5 mm or about 0.3 mm.

In embodiments where the sheet of amorphous solid material does not include a carrier layer, the amorphous solid material may have a thickness of at least about 1 mm and/or of no more than about 2 mm. The amorphous solid material may comprise more than one layer, and the thickness described herein refers to the aggregate thickness of those layers of amorphous solid material.

For the avoidance of doubt, where reference is made herein to area density, this refers to an average area density calculated for a given strip, piece or sheet of amorphous solid material, the area density calculated by measuring the surface area and weight of the given strip, piece or sheet of amorphous solid material.

The thickness stipulated herein is a mean thickness for the material. In some cases, the amorphous solid material thickness may vary by no more than 25%, 20%, 15%, 10%, 5% or 1%.

Portion of Aerosol-Generating Material

The consumables comprise, in addition to the section or plug of amorphous solid material, an aerosol-generating segment comprising at least one aerosol-generating material.

In some embodiments, the aerosol-generating comprises one or more active substances and/or flavors. In some embodiments, this material includes tobacco or other plant derived material. When this aerosol-generating material includes tobacco, heating this material releases volatile tobacco components including nicotine and flavor or aroma compounds.

In some embodiments, the portion of the consumable comprising at least one aerosol-generating material comprises tobacco material. As used herein, the term "tobacco material" refers to any material comprising tobacco or derivatives or substitutes thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, tobacco lamina, reconstituted tobacco and/or tobacco extract.

The tobacco material may be provided in the form of cut rag tobacco. The cut rag tobacco can have a cut width of at least 15 cuts per inch (about 5.9 cuts per cm, equivalent to a cut width of about 1.7 mm). Preferably, the cut rag tobacco has a cut width of at least 18 cuts per inch (about 7.1 cuts per cm, equivalent to a cut width of about 1.4 mm), more preferably at least 20 cuts per inch (about 7.9 cuts per cm, equivalent to a cut width of about 1.27 mm). In one example, the cut rag tobacco has a cut width of 22 cuts per inch (about 8.7 cuts per cm, equivalent to a cut width of about 1.15 mm). Preferably, the cut rag tobacco has a cut width at or below 40 cuts per inch (about 15.7 cuts per cm, equivalent to a cut width of about 0.64 mm). Cut widths between 0.5 mm and 2.0 mm, for instance between 0.6 and 1.7 mm or between 0.6 mm and 1.5 mm, have been found to result in tobacco material which is preferably in terms of surface area to volume ratio, particularly when heated, and the overall density and pressure drop of the rod of aerosol-generating material. The cut rag tobacco can be formed from a mixture of forms of tobacco material, for instance a mixture of one or more of paper reconstituted tobacco, leaf tobacco, extruded tobacco and bandcast tobacco. Preferably the tobacco material comprises paper reconstituted tobacco or a mixture of paper reconstituted tobacco and leaf tobacco.

The tobacco material may have any suitable thickness. The tobacco material may have a thickness of at least about 0.145 mm, for instance at least about 0.15 mm, or at least about 0.16 mm. The tobacco material may have a maximum thickness of about 0.25 mm, for instance the thickness of the tobacco material may be less than about 0.22 mm, or less than about 0.2 mm. In some embodiments, the tobacco material may have an average thickness in the range 0.175 mm to 0.195 mm. Such thicknesses may be particularly suitable where the tobacco material is a reconstituted tobacco material.

The tobacco material can comprise reconstituted tobacco material having a density of less than about 700 mg/cc, for instance paper reconstituted tobacco material. For instance, the aerosol-generating material comprises reconstituted tobacco material having a density of less than about 600 mg/cc. Alternatively or in addition, the aerosol-generating material 3 can comprise reconstituted tobacco material having a density of at least 350 mg/cc.

In some embodiments, the aerosol-generating material contains a filler component. The filler component is generally a non-tobacco component, that is, a component that does not include ingredients originating from tobacco. The filler component may be a non-tobacco fiber such as wood fiber or pulp or wheat fiber. The filler component may also be an inorganic material such as chalk, perlite, vermiculite, diatomaceous earth, colloidal silica, magnesium oxide, magnesium sulphate, magnesium carbonate. The filler component may also be a non-tobacco cast material or a non-tobacco extruded material. The filler component may be present in an amount of 0 to 20% by weight of the tobacco material, or in an amount of from 1 to 10% by weight of the composition. In some embodiments, the filler component is absent.

In some embodiments, the aerosol-generating material contains an aerosol-former material.

In some embodiments, the aerosol-former material included with the tobacco material may be glycerol, propylene glycol, or a mixture of glycerol and propylene glycol. Glycerol may be present in an amount of from 10 to 20% by weight of the tobacco material, for example 13 to 16% by weight of the composition, or about 14% or 15% by weight of the composition. Propylene glycol, if present, may be present in an amount of from 0.1 to 0.3% by weight of the composition.

The tobacco material can contain between 10% and 90% by weight tobacco leaf, wherein the aerosol-former material is provided in an amount of up to about 10% by weight of the leaf tobacco. To achieve an overall level of aerosol-former material between 10% and 20% by weight of the tobacco material, it has been advantageously found that this can be added in higher weight percentages to the another component of the tobacco material, such as reconstituted tobacco material.

The tobacco material described herein contains nicotine. The nicotine content is from 0.5 to 1.75% by weight of the tobacco material, and may be, for example, from 0.8 to 1.5% by weight of the tobacco material. Additionally or alternatively, the tobacco material contains between 10% and 90% by weight tobacco leaf having a nicotine content of greater than 1.5% by weight of the tobacco leaf. It has been advantageously found that using a tobacco leaf with nicotine content higher than 1.5% in combination with a lower nicotine base material, such as paper reconstituted tobacco, provides a tobacco material with an appropriate nicotine level but better sensory performance than the use of paper reconstituted tobacco alone. The tobacco leaf, for instance cut rag tobacco, can, for instance, have a nicotine content of between 1.5% and 5% by weight of the tobacco leaf.

The tobacco material described herein can contain an aerosol modifying agent, such as any of the flavors described herein. In one embodiment, the tobacco material contains menthol, forming a mentholated article. The tobacco material can comprise from 3 mg to 20 mg of menthol, preferably between 5 mg and 18 mg and more preferably between 8 mg and 16 mg of menthol. In the present example, the tobacco material comprises 16 mg of menthol. The tobacco material can contain between 2% and 8% by weight of menthol, preferably between 3% and 7% by weight of menthol and more preferably between 4% and 5.5% by weight of menthol. In one embodiment, the tobacco material includes 4.7% by weight of menthol. Such high levels of menthol loading can be achieved using a high percentage of reconstituted tobacco material, for instance greater than 50% of the tobacco material by weight. Alternatively or additionally, the use of a high volume of aerosol-generating material, for instance tobacco material, can increase the level of menthol loading that can be achieved, for instance where greater than about 500 $mm^3$ or suitably more than about 1000 $mm^3$ of aerosol-generating material, such as tobacco material, are used.

In an embodiment, the tobacco material comprises the tobacco component as defined herein and the aerosol-former material as defined herein. In an embodiment, the tobacco material consists essentially of the tobacco component as defined herein and the aerosol-former material as defined herein. In an embodiment, the tobacco material consists of the tobacco component as defined herein and the aerosol-former material as defined herein.

Paper reconstituted tobacco may be present in the tobacco component of the tobacco material described herein in an amount of from 10% to 100% by weight of the tobacco component. In embodiments, the paper reconstituted tobacco is present in an amount of from 10% to 80% by weight, or 20% to 70% by weight, of the tobacco component. In a further embodiment, the tobacco component consists essentially of, or consists of, paper reconstituted tobacco. In preferred embodiments, leaf tobacco is present in the tobacco component of the tobacco material in an amount of from at least 10% by weight of the tobacco component. For instance, leaf tobacco can be present in an amount of at least 10% by weight of the tobacco component, while the remainder of the tobacco component comprises paper reconstituted tobacco, bandcast reconstituted tobacco, or a combination of bandcast reconstituted tobacco and another form of tobacco such as tobacco granules. Suitably, leaf tobacco can be present in an amount up to 40% or 60% of the tobacco material, while the remainder of the tobacco component comprises paper reconstituted tobacco, bandcast reconstituted tobacco, or a combination of bandcast reconstituted tobacco and another form of tobacco such as tobacco granules.

Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper reconstituted tobacco may be any type of paper reconstituted tobacco that is known in the art. In a particular embodiment, the paper reconstituted tobacco is made from a feedstock comprising one or more of tobacco strips, tobacco stems, and whole leaf tobacco. In a further embodiment, the paper reconstituted tobacco is made from a feedstock consisting of tobacco strips and/or whole leaf tobacco, and tobacco stems. However, in other embodiments, scraps, fines and winnowings can alternatively or additionally be employed in the feedstock.

The paper reconstituted tobacco for use in the tobacco material described herein may be prepared by methods which are known to those skilled in the art for preparing paper reconstituted tobacco.

The density of the tobacco material has an impact on the speed at which heat conducts through the material, with lower densities, for instance those below 700 mg/cc, conducting heat more slowly through the material, and therefore enabling a more sustained release of aerosol.

In some embodiments, the aerosol-generating material comprising a blend of at least two aerosol-generating materials. In such embodiments, the bend may comprise a first component comprising tobacco material and a second component comprising amorphous solid material as described herein. Such aerosol-generating material can, for example, provide an aerosol, in use, with a desirable flavor profile, since additional flavor may be introduced to the aerosol-generating material by inclusion in the amorphous solid material component. As described above, tobacco material having a density of at least 350 mg/cc and less than about 700 mg/cc has been advantageously found to result in a more sustained release of aerosol. To provide an aerosol having a consistent flavor profile the amorphous solid material component of the aerosol-generating material should be evenly distributed throughout the rod. This can be achieved by casting the amorphous solid material to have an area density which is similar to the area density of the tobacco material, and processing the amorphous solid material to ensure an even distribution throughout the aerosol-generating material.

In some embodiments, even mixing of the tobacco material component and the amorphous solid material component can be achieved when the amorphous solid material in sheet form is shredded. Preferably the cut width of the shredded amorphous solid material is between 0.75 mm and 2 mm, for instance between 1 mm and 1.5 mm. The strands of amorphous solid material formed by shredding may be cut width-wise, for example in a cross-cut type shredding process, to define a cut length for the shredded amorphous solid material, in addition to a cut width. The cut length of the shredded amorphous solid material is preferably at least 5 mm, for instance at least 10 mm, or at least 20 mm. The cut length of the shredded amorphous solid material can be less than 60 mm, less than 50 mm, or less than 40 mm. In some embodiments, to achieve even mixing of the shredded amorphous solid material with cut rag tobacco, the cut length of the shredded amorphous solid material is preferably non-uniform. Although referred to as cut length, the length of the shreds or strips of amorphous solid material can alternatively or additionally be dictated by a dimension of the material determined during its manufacture, for instance the width of a sheet of the material as manufactured.

In exemplary embodiments, the aerosol-generating material comprises a first component comprising a tobacco material in an amount from 50% to 98%, for instance from 80% to 95%, wherein the tobacco material is for instance provided as a cut rag tobacco, and a second component comprising shredded amorphous solid material in an amount from 2% to 50%, for instance from 5% to 20%.

Substances to be Delivered

The consumables for use with the non-combustible aerosol provision device comprise aerosol-generating material, part or all of which is intended to be consumed during use by a user.

In some embodiments, the substance to be delivered comprises an active substance. The substance to be delivered may be present in any one or more of the aerosol-generating materials included in the consumable.

The active substance as used herein may be a physiologically active material, which is a material intended to achieve or enhance a physiological response. The active substance may for example be selected from nutraceuticals, nootropics, and psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v., *Mentha spicata crispa, Mentha cardifolia, Mentha longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

In some embodiments, the aerosol-generating material in the aerosol-generating segment of the consumable comprises an active substance. In some embodiments, the amorphous solid material does not include an active substance.

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

In some embodiments, the aerosol-generating material segment of the consumable comprises a flavor. In some embodiments, the amorphous solid material includes a flavor. In other embodiments, the amorphous solid material does not include a flavor.

In addition to the aerosol-generating segment comprising at least one aerosol-generating material and the mouthpiece segment comprising a section of an amorphous solid material, the consumable may, in some embodiments, further comprise one or more of: an aerosol-generating material storage area, an aerosol-generating material transfer component, an aerosol generator, an aerosol generation area, a housing, a wrapper, a filter, and/or an aerosol-modifying agent.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component that is operable to selectively release the aerosol-modifying agent The aerosol-modifying agent may, for example, be an additive or a sorbent. The aerosol-modifying agent may, for example, comprise one or more of a flavorant, a colourant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

In some embodiments, the aerosol modifying agent can be provided as material injected into the consumable or provided on a thread, for instance the thread carrying a flavorant or other aerosol modifying agent, which may also be disposed within the mouthpiece segment.

In some embodiments, the aerosol-modifying agent is provided in breakable capsule, for instance a capsule which has a solid, frangible shell surrounding a liquid payload. A single capsule or multiple capsules may be used. In some embodiments, the one or more capsules are positioned in the mouthpiece, for example, embedded in a plug of fibrous material.

In other embodiments, an aerosol-modifying agent or other sensate material is provided on a wrapper surrounding the consumable, such as the mouthpiece wrapper. The aerosol modifying agent may be disposed on an inwardly or outwardly facing surface.

Consumable Design

Consumables, also referred to as articles herein, may be in the shape of rods. Such rods are often named according to the product length: "regular" (typically in the range 68 to 75 mm, e.g. from about 68 mm to about 72 mm), "short" or "mini" (68 mm or less), "king-size" (typically in the range 75 to 91 mm, e.g. from about 79 mm to about 88 mm), "long" or "super-king" (typically in the range 91 to 105 mm, e.g. from about 94 mm to about 101 mm) and "ultra-long" (typically in the range from about 110 mm to about 121 mm).

They are also named according to the product circumference: "regular" (about 23 to 25 mm), "wide" (greater than 25 mm), "slim" (about 22 to 23 mm), "demi-slim" (about 19 to 22 mm), "super-slim" (about 16 to 19 mm), and "micro-slim" (less than about 16 mm).

Accordingly, an article in a king-size, super-slim format will, for example, have a length of about 83 mm and a circumference of about 17 mm. Articles and their aerosol-generating materials and mouthpieces described herein can be made in, but are not limited to, any of the above formats.

Each format may be produced with portions of different lengths. As discussed above, there is a portion comprising at least one aerosol-generating material and a first plug or section of an amorphous solid material. The rod may be made up of cylindrical portions aligned and positioned in abutment to form the rod-shaped consumable.

In some embodiments, the consumables may have a circumference of about 21 mm or about 23 mm. The length of the consumable may be, for example, 75 mm, 63 mm, 57 mm or 48 mm. Some consumables may have a length of less than 35 mm. In such short consumables, the portion comprising aerosol-generating material may extend along from about 50% to about 75% of the length of the consumable.

As discussed, the consumable comprises an aerosol-generating segment comprising at least one aerosol-generating material and a mouthpiece segment comprising a section of an amorphous solid material. The aerosol-generating segment may comprise multiple sections. At least one of these sections comprises one or more aerosol-generating materials. Other sections may be cavities, separating the sections of the segments of the consumable. In some embodiments, one or more of the sections in the aerosol-generating segment of the consumable may comprise an amorphous solid material as an aerosol-generating material.

In addition or alternatively, the mouthpiece segment of the consumable may comprise multiple sections.

The terms 'upstream' and 'downstream' used herein are relative terms defined in relation to the direction of mainstream aerosol drawn though an article or device in use.

The mouthpiece segment may have a length of from about 30 mm to 50 mm. A tipping paper may connect the mouthpiece to the next portion of the consumable.

In some embodiments, the mouthpiece segment comprises a section comprising a filamentary tow material, for example a cellulose acetate fiber tow. The filamentary tow can also be formed using other materials used to form fibers, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, cotton, aliphatic polyester materials and polysaccharide polymers or a combination thereof. The filamentary tow may be plasticised with a suitable plasticiser for the tow, such as triacetin where the material is cellulose acetate tow, or the tow may be non-plasticised.

In some embodiments, the portion comprising the filamentary tow material comprises a plug or body of filamentary tow material.

In some embodiments, the mouthpiece segment includes a plug or body of filamentary tow material at the mouth end. Alternatively or in addition, mouthpiece segment includes a plug or body of filamentary tow material at its distal end, positioned adjacent to the next portion of the consumable.

In some embodiments, the mouthpiece segment may comprise one or more hollow tubular elements.

In some embodiments, the mouthpiece segment includes a hollow tubular element at the mouth end. Alternatively or in addition, mouthpiece segment includes a hollow tubular element at its distal end, positioned adjacent to the next portion of the consumable.

In some embodiments, the hollow tubular element is a paper tube. In other embodiments, the hollow tubular element is formed from filamentary tow.

A hollow tubular element positioned in the mouthpiece has advantageously been found to significantly reduce the temperature of the outer surface of the mouthpiece at the downstream end the mouthpiece which comes into contact with a consumer's mouth when the article is in use. In addition, the use of the tubular element has also been found to significantly reduce the temperature of the outer surface of the mouthpiece even upstream of the hollow tubular element. Without wishing to be bound by theory, it is hypothesised that this is due to the tubular element channelling aerosol closer to the centre of the mouthpiece, and therefore reducing the transfer of heat from the aerosol to the outer surface of the mouthpiece.

The "wall thickness" of the hollow tubular element corresponds to the thickness of the wall of the tube in a radial direction. This may be measured, for example, using a calliper. The wall thickness is advantageously greater than 0.9 mm, and more preferably 1.0 mm or greater. Preferably, the wall thickness is substantially constant around the entire wall of the hollow tubular element 4. However, where the wall thickness is not substantially constant, the wall thickness is preferably greater than 0.9 mm at any point around the hollow tubular element 4, more preferably 1.0 mm or greater.

In some embodiments, the length of the hollow tubular element is less than about 20 mm Optionally, the length of the hollow tubular element is less than about 15 mm, or it is less than about 10 mm. In addition, or as an alternative, the length of the hollow tubular element is at least about 5 mm, at least about 6 mm, or from about 5 mm to about 20 mm, from about 6 mm to about 10 mm, from about 6 mm to about 8 mm, or has a length of about 6 mm, 7 mm or about 8 mm.

In some embodiments, the density of the hollow tubular element is at least about 0.25 grams per cubic centimetre (g/cc), at least about 0.3 g/cc, and/or is less than about 0.75 grams per cubic centimetre (g/cc), or less than 0.6 g/cc. In some embodiments, the density of the hollow tubular element is between 0.25 and 0.75 g/cc, between 0.3 and 0.6 g/cc, or between 0.4 g/cc and 0.6 g/cc or about 0.5 g/cc. These densities have been found to provide a good balance between improved firmness afforded by denser material and the lower heat transfer properties of lower density material. For the purposes of the present invention, the "density" of the hollow tubular element refers to the density of the filamentary tow forming the element with any plasticiser incorporated. The density may be determined by dividing the total weight of the hollow tubular element by the total volume of the hollow tubular element, wherein the total volume can be calculated using appropriate measurements of the hollow tubular element taken, for example, using callipers. Where necessary, the appropriate dimensions may be measured using a microscope.

In some embodiments, the hollow tubular element has an internal diameter of greater than 3 mm. Smaller diameters than this can result in increasing the velocity of aerosol passing though the mouthpiece to the consumer's mouth more than is desirable, such that the aerosol becomes too warm, for instance reaching temperatures greater than 40° C. or greater than 45° C. In some embodiments, the hollow tubular element has an internal diameter of greater than 3.1 mm, and still more preferably greater than 3.5 mm or 3.6 mm. In one embodiment, the internal diameter of the hollow tubular element is about 3.9 mm.

In some embodiments, the hollow tubular element defines an air gap within the mouthpiece which acts as a cooling segment. The air gap provides a chamber through which heated volatilized components generated by the aerosol-generating material flow. The hollow tubular element is hollow to provide a chamber for aerosol accumulation yet rigid enough to withstand axial compressive forces and bending moments that might arise during manufacture and whilst the consumable is in use. The hollow tubular element provides a physical displacement between the aerosol-generating material and the plug of filter material. The physical displacement provided by the hollow tubular element will provide a thermal gradient across the length of the hollow tubular element.

In some embodiments, the mouthpiece comprises a cavity having an internal volume of at least 450 $mm^3$. Providing a cavity of at least this volume has been found to enable the formation of an improved aerosol. Such a cavity size provides sufficient space within the mouthpiece to allow heated volatilized components to cool, therefore allowing the exposure of the aerosol-generating material to higher temperatures than would otherwise be possible, since they may result in an aerosol which is too warm.

In some embodiments, the hollow tubular element can be configured to provide a temperature differential of at least 40° C. between a heated volatilized component entering a first, upstream end of the hollow tubular element and a heated volatilized component exiting a second, downstream end of the hollow tubular element. The hollow tubular element is preferably configured to provide a temperature differential of at least 60° C., at least 80° C. or at least 100° C. This temperature differential across the length of the hollow tubular element protects the temperature sensitive plug of filter material from the high temperatures of the aerosol-generating material when it is heated.

In some embodiments, the section of amorphous solid material is positioned adjacent to the aerosol-generating segment. The section of amorphous solid material may have a length of from about 5 mm to about 20 mm. In some embodiments, the section of amorphous solid material may have a length of from about 7 to about 15 mm.

In some embodiments, the consumable comprises two or more shorter sections of amorphous solid material, at least one of which is located in the mouthpiece segment.

In some embodiments, the portion comprising at least one aerosol-generating material is positioned at the distal end of the consumable. This portion comprising at least one aerosol-generating material may have a length of from about 5 mm to about 20 mm. In some embodiments, this portion may have a length of from about 7 to about 15 mm. Alternatively, the consumable may comprise two or more shorter portions of aerosol-generating material. In some embodiments, the portion of aerosol-generating material is longer that the section of amorphous solid material.

In some embodiments, the portion comprising at least one aerosol-generating material may be positioned directly adjacent to the section of amorphous solid material. Alternatively, these portions of the consumable may be separated, for example by a further portion comprising a hollow tubular element or a plug of fibrous tow.

In some embodiments, the overall length of the part of the consumable comprising aerosol-generating material and amorphous solid material is from about 10 mm to about 50 mm, or from about 25 mm to about 40 mm.

In some embodiments, the aerosol-generating material is wrapped in a wrapper. The wrapper can, for instance, be a paper or paper-backed foil wrapper. In the present example, the wrapper is substantially impermeable to air. In alternative embodiments, the wrapper has a permeability of less than 100 Coresta Units, or less than 60 Coresta Units. It has been found that such low permeability wrappers result in an improvement in the aerosol formation in the aerosol-generating material. Without wishing to be bound by theory, it is hypothesised that this is due to reduced loss of aerosol compounds through the wrapper. The permeability of the wrapper can be measured in accordance with ISO 2965:2009 concerning the determination of air permeability for materials used as cigarette papers, filter plug wrap and filter joining paper.

In some embodiments, the wrapper comprises aluminium foil. Aluminium foil has been found to be effective at enhancing the formation of aerosol within the aerosol-generating material. For example, the aluminium foil may have a metal layer having a thickness of about 6 μm. In some embodiments, the aluminium foil has a paper backing. However, in alternative arrangements, the aluminium foil can be other thicknesses, for instance between 4 μm and 16 μm in thickness. The aluminium foil also need not have a paper backing, but could have a backing formed from other materials, for instance to help provide an appropriate tensile strength to the foil, or it could have no backing material. Metallic layers or foils other than aluminium can also be used. The total thickness of the wrapper is preferably between 20 μm and 60 μm, more preferably between 30 μm and 50 μm, which can provide a wrapper having appropriate structural integrity and heat transfer characteristics. The tensile force which can be applied to the wrapper before it breaks can be greater than 3,000 grams force, for instance between 3,000 and 10,000 grams force or between 3,000 and 4,500 grams force.

In some embodiments, the consumable is ventilated. For example, the consumable may have a ventilation level of about 75% of the aerosol drawn through the article. In alternative embodiments, the consumable can have a ventilation level of between 50% and 80% of aerosol drawn through the article, for instance between 65% and 75%. Ventilation at these levels helps to slow down the flow of aerosol drawn through the mouthpiece and thereby enable the aerosol to cool sufficiently before it reaches the downstream end of the mouthpiece. The ventilation may be provided directly into the mouthpiece of the article. In some embodiments, the ventilation is provided into hollow tubular element of the mouthpiece, which has been found to be particularly beneficial in assisting with the aerosol generation process.

In some embodiments, the ventilation is provided via first and second parallel rows of perforations, for example, formed as laser perforations, at positions between 15 mm and 20 mm from the downstream, mouth end of the mouthpiece. In alternative embodiments, the ventilation can be provided into the mouthpiece at other locations, for instance into the body of material or into a mouth end hollow tubular element.

In some embodiments, the aerosol-generating segment of the consumable is a cylindrical rod of aerosol-generating material. Irrespective of the form or make up of the aerosol-generating material, it preferably has a length of about 10 mm to 100 mm. In some embodiments, the length of the aerosol-generating material is preferably in the range about 25 mm to 50 mm, more preferably in the range about 30 mm to 45 mm, and still more preferably about 30 mm to 40 mm.

The volume of aerosol-generating material provided can vary from about 200 $mm^3$ to about 4300 $mm^3$, from about 500 $mm^3$ to 1500 $mm^3$, or from about 1000 $mm^3$ to about 1300 $mm^3$. The provision of these volumes of aerosol-generating material, for instance from about 1000 $mm^3$ to about 1300 $mm^3$, has been advantageously shown to achieve a superior aerosol, having a greater visibility and sensory performance compared to that achieved with volumes selected from the lower end of the range.

The mass of aerosol-generating material provided can be greater than 200 mg, for instance from about 200 mg to 400 mg, from about 230 mg to 360 mg, or from about 250 mg to 360 mg. It has been advantageously found that providing a higher mass of aerosol-generating material results in improved sensory performance compared to aerosol generated from a lower mass of tobacco material.

Delivery Systems

As used herein, the term "delivery system" is intended to encompass systems that deliver at least one substance to a user, and includes non-combustible aerosol provision systems that release compounds from an aerosol-generating material without combusting the aerosol-generating material, such as electronic cigarettes, tobacco heating products, and hybrid systems to generate aerosol using a combination of aerosol-generating materials.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an aerosol-generating material heating system, also known as a heat-not-burn system. An example of such a system is a tobacco heating system.

In some embodiments, the non-combustible aerosol provision system generates aerosol using a combination of aerosol-generating materials, one or a plurality of which may be heated. Each of the aerosol-generating materials may or may not contain nicotine.

Typically, the non-combustible aerosol provision system may comprise a non-combustible aerosol provision device and a consumable for use with the non-combustible aerosol provision device.

A non-combustible aerosol provision device, also referred to herein as an aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energised so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the non-combustible aerosol provision device heats different parts of the consumable separately, for example at different times and/or to different temperatures. The design of the consumable will correspond to the heating arrangement, to ensure that the different aerosol-generating materials are heated to the correct temperature to provide an aerosol for inhalation and to having the desired make up.

In some embodiments, the non-combustible aerosol provision system includes a device with two or more heating zones. The heating zones may separately heat different parts of the aerosol-generating segment of the consumable. This means that the consumable design may be configured to utilise the heating zones in the best possible manner.

Different parts or portions of the aerosol-generating segment of the consumable may be heated to different temperatures. Alternatively, the heating zones may be activated at different times.

In the figures described herein, like reference numerals are used to illustrate equivalent features, articles or components.

FIG. 1 is a side-on cross sectional view of a consumable or article 1 for use in an aerosol delivery system, according to a first embodiment.

The article 1 comprises a mouthpiece 2, and an aerosol-generation segment 3. The aerosol-generating segment comprises a cylindrical rod comprising a section or plug of an aerosol-generating material 5. The mouthpiece segment comprises a section of amorphous solid material 4 and a mouth end plug of filamentary tow material 6. Between the portion of aerosol-generating material 5 and the section of amorphous solid material 4, there is positioned a hollow tubular element 7. In the illustrated embodiment, the hollow tubular element 7 is a paper tube.

Although described above in rod form, the aerosol-generating material can be provided in other forms, for instance a plug, pouch, or packet of material within an article.

In some embodiments, the aerosol-generating material 5 is a tobacco material. In the example illustrated, the tobacco material preferably comprises a paper reconstituted tobacco material. The tobacco material can alternatively or additionally comprise any of the forms described herein. The tobacco material contains between 10% and 90% by weight tobacco leaf, and an aerosol-former material is provided in an amount of up to about 10% by weight of the leaf tobacco, and the remainder of the tobacco material comprises paper reconstituted tobacco.

In the illustrated example, the amorphous solid material is a dried gel comprising menthol. In alternative embodiments, the amorphous solid material may have any composition as described herein.

In embodiments described herein, the amorphous solid material may be incorporated into the article in sheet form. The amorphous solid material sheet may be incorporated as a planar sheet, as a gathered or bunched sheet, as a crimped sheet, or as a rolled sheet (i.e. in the form of a tube). In some such cases, the amorphous solid material of these embodiments may be included in an aerosol-generating article as a sheet, such as a sheet circumscribing a rod of aerosolizable material (e.g. tobacco). For example, the amorphous solid material sheet may be formed on a wrapping paper which circumscribes an aerosolizable material such as tobacco. Alternatively, the amorphous solid material in sheet form may be shredded and then incorporated into the article. In some embodiments, the shredded material comprises elongate strips of amorphous solid material. The elongate strips may be substantially aligned with the longitudinal axis of the consumable.

The segment comprising aerosol-generating material 3 can be provided in the form of a rod comprising cut rag reconstituted tobacco. The aerosol-generating material can be any of the materials discussed herein.

Figure 2:
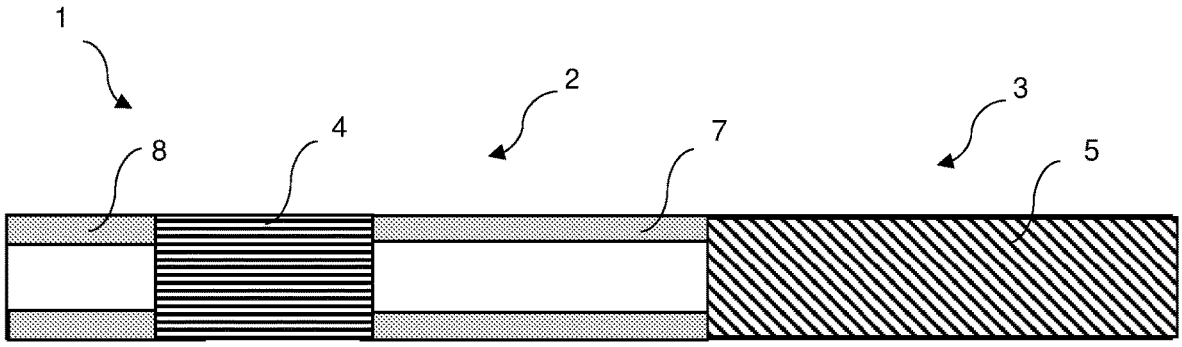
FIG. 2 is a side-on cross sectional view of a second embodiment of a consumable for use with a non-combustible aerosol provision device.

FIG. 2 is a side-on cross sectional view of an alternative embodiment of a consumable or article 1 for use in an aerosol delivery system.

In this embodiment, the article 1 comprises a mouthpiece 2 which comprises a hollow tubular element 7 at the mouth end, adjacent to a section of amorphous solid material 4, which also abuts a further a hollow tubular element 7. The article 1 further comprises an aerosol-generating segment 3 comprising a section of aerosol-generating material 5.

In the illustrated embodiment, the mouth end hollow tubular element 8 is formed from a filamentary tow material. The other hollow tubular element 7 may be a paper tube.

Figure 3:
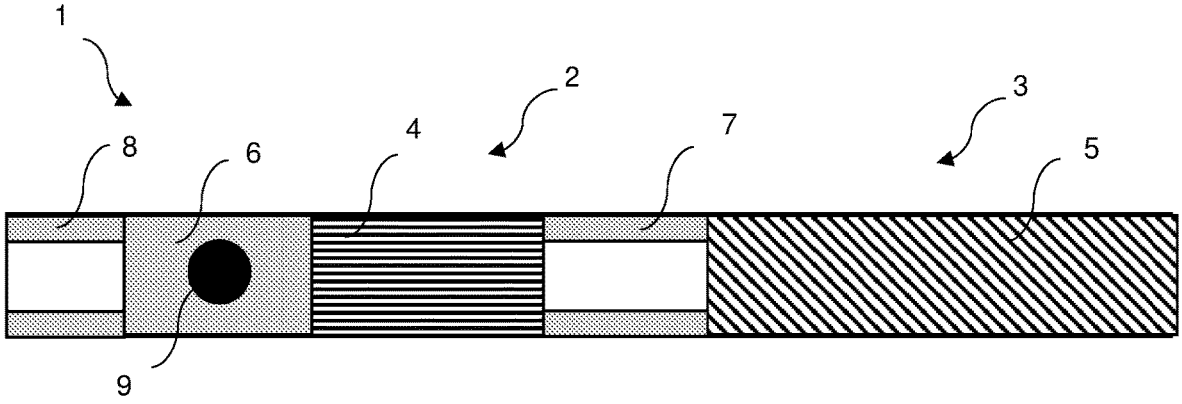
FIG. 3 is a side-on cross sectional view of a third embodiment of a consumable for use with a non-combustible aerosol provision device.

As shown in FIG. 3, in further embodiments, the mouthpiece 2 of the article 1 comprises a mouth end hollow tubular element 8, adjacent to a plug of material such as filamentary tow 6, which, at its other end, abuts a section of amorphous solid material 4. A further hollow tubular element 7 is positioned between the section of amorphous solid material 4 and the section of aerosol-generating material 5.

In the illustrated embodiment, the mouth end hollow tubular element 8 is formed from a filamentary tow material. The plug of filamentary tow 6 has embedded within the material a frangible capsule 9 with a flavor-carrying payload. Such a capsule may be included in any of the illustrated consumables, either in the plug of filamentary tow as shown in FIG. 3, or in any other suitable sections of the consumable.

Figure 4:
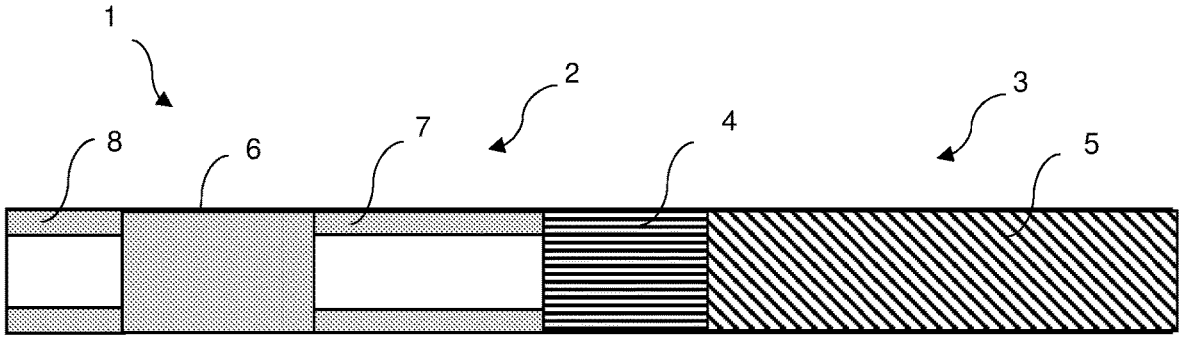
FIG. 4 is a side-on cross sectional view of a fourth embodiment of a consumable for use with a non-combustible aerosol provision device.

In the embodiment illustrated in FIG. 4, the section of amorphous solid material 4 is positioned adjacent to the aerosol-generating segment 3. In this embodiment, the mouthpiece 2 of the article 1 comprises a mouth end hollow tubular element 8, adjacent to a plug of material such as filamentary tow 6, which, at its other end, abuts a further hollow tubular element 7.

Figure 5:
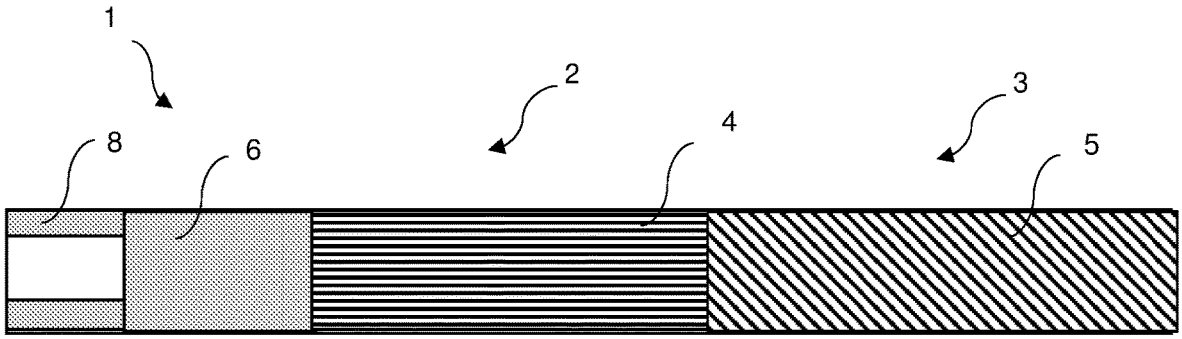
FIG. 5 is a side-on cross sectional view of a fifth embodiment of a consumable for use with a non-combustible aerosol provision device.

In the embodiment illustrated in FIG. 5, a longer section of amorphous solid material 4 is positioned adjacent to the aerosol-generating segment 3. In this embodiment, the mouthpiece 2 of the article 1 further comprises a mouth end hollow tubular section 8, adjacent to a plug of material such as filamentary tow 6, which, at its other end, abuts the section of amorphous solid material 4.

In the illustrated embodiments shown in FIGS. 1 to 5, the article 1 has an outer circumference of about 21 mm (i.e. the article is in the demi-slim format). In other embodiments, the article can be provided in any of the formats described herein, for instance having an outer circumference of between 15 mm and 25 mm. Since the article is to be heated to release an aerosol, improved heating efficiency can be achieved using articles having lower outer circumferences within this range, for instance circumferences of less than 23 mm. To achieve improved aerosol via heating, while maintaining a suitable product length, article circumferences of greater than 19 mm have also been found to be particularly effective. Articles having circumferences of between 19 mm and 23 mm, and more preferably between 20 mm and 22 mm, have been found to provide a good balance between providing effective aerosol delivery while allowing for efficient heating.

The outer circumference of each portion of the rod is substantially the same, such that there is a smooth transition between them. In the illustrated embodiments, the outer circumference of the portions is about 20.8 mm. One or more wrappers are wrapped around the rod shaped consumable and adhered to hold the portions in place. The wrapper is selected to have acceptable tensile strength while being flexible enough to wrap around the article 1 and adhere to itself along a longitudinal lap seam on the paper. The outer circumference of the rod, once wrapped, is about 21 mm.

According to embodiments described herein, a pack can be provided comprising a plurality of consumables or articles as described herein.

Figure 6:
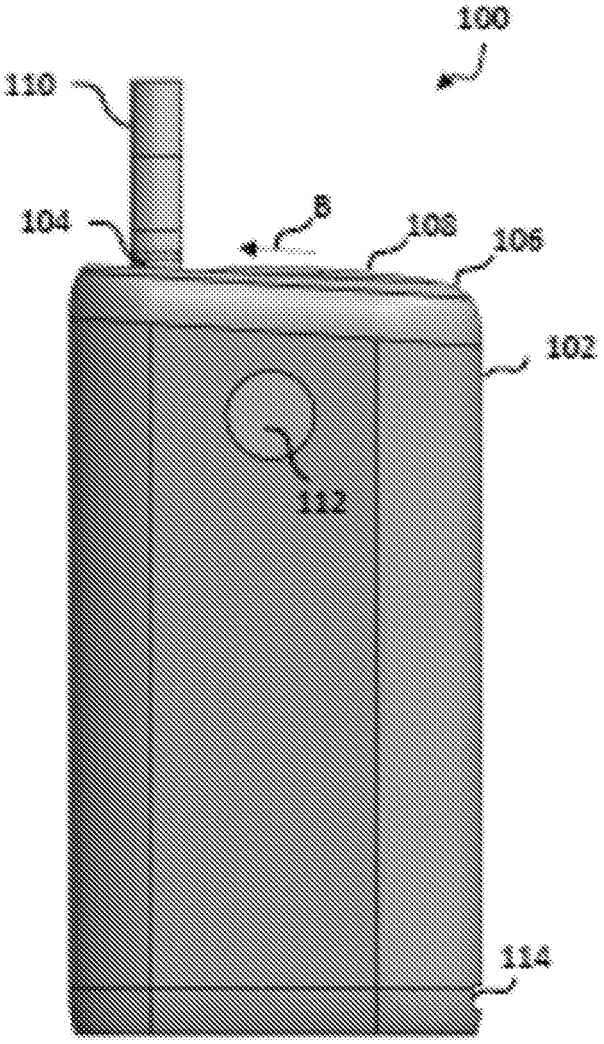
FIG. 6 is a perspective illustration of a non-combustible aerosol provision device for generating aerosol from the aerosol-generating material of the consumables of FIGS. 1 to 5.

FIG. 6 shows an example of a non-combustible aerosol provision device 100 for generating aerosol from an aerosol-generating medium/material such as the aerosol-generating material of a consumable 110, as described herein. In broad outline, the device 100 may be used to heat a replaceable article 110 comprising the aerosol-generating medium, for instance an article 1 as illustrated in any one of FIGS. 1 to 5 or as described elsewhere herein, to generate an aerosol or other inhalable medium which is inhaled by a user of the device 100. The device 100 and replaceable article 110 together form a system.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 6, the lid 108 is shown in an open configuration, however the lid 108 may move into a closed configuration. For example, a user may cause the lid 108 to slide in the direction of arrow "B".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

In the compositions described herein, where amounts are given in % by weight (wt %), for the avoidance of doubt this refers to a dry weight basis, unless specifically indicated to the contrary. Thus, any water that may be present in the tobacco material, or in any component thereof, is entirely disregarded for the purposes of the determination of the weight %. The water content of the tobacco material described herein may vary and may be, for example, from 5 to 15% by weight. The water content of the tobacco material described herein may vary according to, for example, the temperature, pressure and humidity conditions at which the compositions are maintained. The water content can be determined by Karl-Fisher analysis, as known to those skilled in the art. On the other hand, for the avoidance of doubt, even when the aerosol-former material is a component that is in liquid phase, such as glycerol or propylene glycol, any component other than water is included in the weight of the tobacco material. However, when the aerosol-former material is provided in the tobacco component of the tobacco material, or in the filler component (if present) of the tobacco material, instead of or in addition to being added separately to the tobacco material, the aerosol-former material is not included in the weight of the tobacco component or filler component, but is included in the weight of the "aerosol-former material" in the weight % as defined herein. All other ingredients present in the tobacco component are included in the weight of the tobacco component, even if of non-tobacco origin (for example non-tobacco fibers in the case of paper reconstituted tobacco).

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A consumable for use in a non-combustible aerosol provision system comprising an aerosol-generating segment comprising at least one aerosol-generating material and a mouthpiece segment comprising a section of an amorphous solid material comprising a gelling agent and an aerosol-forming material comprising one or more selected from the group consisting of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

2. The consumable as claimed in claim 1, the consumable having a form of a rod having a first end and a second end, the rod comprising a plurality of portions, one of which comprises the section of the amorphous solid material and at least one portion comprising the at least one aerosol-generating material.

3. The consumable as claimed in claim 1, wherein the section of the amorphous solid material comprises a gathered sheet of amorphous solid material.

4. The consumable as claimed in claim 1, wherein the section of the amorphous solid material comprises elongate strips of the amorphous solid material, optionally wherein the elongate strips are substantially aligned with a longitudinal axis of the consumable.

5. The consumable as claimed in claim 1, wherein the amorphous solid material has a thickness of between about 0.5 mm and about 2 mm.

6. The consumable as claimed in claim 1, wherein the amorphous solid material is provided on a supporting material, optionally wherein the supporting material is paper or foil.

7. The consumable as claimed in claim 1, wherein the amorphous solid material is crimped.

8. The consumable as claimed in claim 1, wherein the gelling agent is one or more selected from the group consisting of carboxymethyl cellulose, alginate, pectin, gelatin, polysaccharide, guar gum and carageenan.

9. The consumable as claimed in claim 1, wherein the aerosol-forming material is one or more selected from the group consisting of: erythritol, propylene glycol, glycerol, vegetable glycerine, triacetin, sorbitol and xylitol.

10. The consumable as claimed in claim 1, wherein the amorphous solid material comprises a flavorant, and optionally, wherein the flavorant is menthol.

11. The consumable as claimed in claim 1, wherein the at least one aerosol-generating material of the aerosol-generating segment comprises tobacco material, optionally wherein the tobacco material comprises a reconstituted tobacco material.

12. The consumable as claimed in claim 1, wherein the mouthpiece segment further comprises a body of fibrous material.

13. The consumable as claimed in claim 1, wherein the mouthpiece segment comprises a hollow tubular element, optionally wherein the hollow tubular element is a paper tube or is formed from filamentary tow or wherein the hollow tubular element is positioned between the section of amorphous solid material and the portion comprising an aerosol-generating material.

14. The consumable as claimed in claim 1, wherein the section of the amorphous solid material and the aerosol-generating segment are directly adjacent one another.

15. The consumable as claimed in claim 1, comprising a hollow tubular element at a mouth end.

16. The consumable as claimed in claim 1, the mouthpiece segment comprising one or more flavor modifying elements, optionally, wherein the one or more flavor modifying elements is a capsule.

17. The consumable as claimed in claim 1, wherein the amorphous solid material has a thickness of between about 1 mm and about 2 mm.

18. The consumable as claimed in claim 1, wherein the aerosol-forming material comprises a paper reconstituted tobacco material.

19. The consumable as claimed in claim 6, wherein the supporting material comprises a susceptor.

20. A non-combustible aerosol provision system comprising a non-combustible aerosol provision device and the consumable as claimed in claim 1.

21. A method for producing the consumable as claimed in claim 1, comprising gathering a sheet of amorphous solid material to form the section of the amorphous solid material.

22. A method for producing the consumable as claimed in claim 1, comprising cutting a sheet of amorphous solid material to form a plurality of strips of amorphous solid material from which the section of the amorphous solid material is formed, optionally wherein the plurality of strips have a cut length of at least about 5 mm.

23. A method of use of a section of amorphous solid material comprising a gelling agent and an aerosol-forming material in a consumable to reduce the temperature of an aerosol upon use of the consumable in a non-combustible aerosol provision system, comprising providing the section of the amorphous solid material in a mouthpiece segment of the consumable, wherein the aerosol-forming material comprises one or more selected from the group consisting of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

* * * * *